US005089744A

United States Patent [19]

Park

[11] Patent Number: 5,089,744

[45] Date of Patent: Feb. 18, 1992

[54] MAGNETRON CHOKE FOR MICROWAVE OVEN

[75] Inventor: Seung H. Park, SuWon, Rep. of Korea

[73] Assignee: Goldstar Co., Ltd., Rep. of Korea

[21] Appl. No.: 526,972

[22] Filed: May 22, 1990

[30] Foreign Application Priority Data

May 30, 1989 [KR] Rep. of Korea ..... 7159/1989

[51] Int. Cl.[5] ..... H01J 23/15

[52] U.S. Cl. ..... 315/39.53; 315/39.51; 331/91

[58] Field of Search ..... 315/39.51, 39.53, 39.77, 315/39.75, 85; 331/86, 88, 90, 91

[56] References Cited

U.S. PATENT DOCUMENTS 3,849,737 11/1974 Oguro ..... 331/86
4,459,563 7/1984 Kawaguchi ..... 315/39.53 X
4,833,367 5/1989 Harada ..... 331/91 X

FOREIGN PATENT DOCUMENTS 0288347 12/1986 Japan ..... 315/39.51
0024535 2/1987 Japan ..... 315/39.51
0122028 6/1987 Japan ..... 315/39.51

*Primary Examiner*—Eugene R. LaRoche
*Assistant Examiner*—Seung Ham
*Attorney, Agent, or Firm*—Anthony J. Casella; Gerald E. Hespos

[57] ABSTRACT

A magnetron choke for microwave ovens has a tube member having its wall divided into two side walls of different heights respectively on each side of slots in the tube wall to provide two resonant points for suppressing harmonics in a wider range of frequency bands. Another tube member arranged on the bottom of the former can suppress frequency further in a wider range.

8 Claims, 5 Drawing Sheets

MAGNETRON CHOKE FOR MICROWAVE OVEN

BACKGROUND OF THE INVENTION

The present invention relates to a magnetron for microwave ovens, and in particular, to an improved choke which is fitted in the magnetron to suppress, within a wide band zone, the harmonics generated during operation of the magnetron.

To help understand the present invention, a conventional magnetron and a choke in it shall be described with reference to FIGS. 7 and 8 in the attached drawings.

As shown in FIG. 7, the magnetron for microwave ovens includes: an anode resonant circuit section comprising a cylindrical anode block 5, vanes 6 fixed in a radial arrangement within the anode block 5 and an antenna feeder 7 electrically connecting to an end of a vane 6. A cathode section comprising a coiled filament 8 is set on the axis of the anode block 5 and held by end heads 9 and 10 between them and leads 11; a magnetic circuit comprising an electrode 12 fixed at its top and bottom to the block 5 and includes a permanent magnet 13. On the circumference of the antenna feeder 7 there are assembled a cylindrical metal seal 14, a ceramic member 15, discharge tube 16 and a cap antenna 17; on the circumference of the leads 11 are assembled a cylindrical metal seal 18, a ceramic insulator 19 and a terminal 20. The anode block 5 connects to cooking pins 21.

Upon turning on the microwave oven, the anode resonant circuit section oscillates at a frequency of microwave band, and heats the filament 8 to radiate thermoelectron for dc current to apply between the resonant circuit and the cathode section, the thermoelectron picking up energy from the magnetic force of the magnet 13 to rapidly rotate within the operational space between the vanes 6 and the filament 8.

Further, when the rotational velocity of the thermoelectron is adjusted by means of controlling dc voltage between the permanent magnet and the anode block to synchronize with the phase velocity of the high frequency field electrically oscillating at the resonant circuit of the anode block, the high frequency energy of a predetermined frequency (2450 MHz) is generated to radiate through the antenna 7 to the exterior and apply to the food for cooking.

Also, with the magnetron in operation, the resonant circuit generates in addition to its resonant frequency, a higher harmonic in the frequency of an integral multiple of the resonant frequency, and when directly applied, the harmonic causes noises in other electric instruments. Besides, when the harmonic comes to the frequency of five times the resonant frequency to be equal to the frequency for satellite broadcasts, the harmonic gives rise to a serious interference in radiowave broadcastings. Thus, a magnetron is usually equiped with a choke for suppressing harmonic generation within the device.

Generally one or two such chokes are installed within the cylindrical metal seal 14 as shown in FIG. 7. In the conventional art, a choke has been in use with a construction, as shown in FIG. 8, having a flange 1 and a tube member 2 being integral with the flange 1 on its top side and having the length (1) of one-quarter of the frequency to be suppressed.

The conventional choke construction however allows a choke to suppress only the frequency in one band zone, and thus for suppressing frequencies in a wide zone of bands, the construction requires a number of chokes each having the tube member in a different length to be installed within the seal 14.

However, the inner space within the seal is so limited that the disposition of a number of chokes practically is not feasible.

SUMMARY OF THE INVENTION

To eliminate the above mentioned problems in the conventional choke, the present invention arranges for a choke to have two resonant points for suppressing frequencies in two different band zones.

Figure 1:
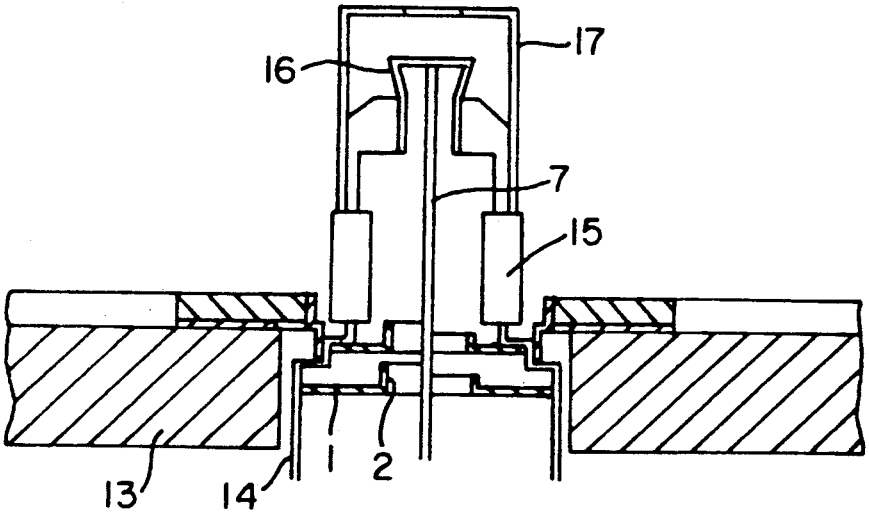
FIG. 1 shows a partial section of a magnetron having a choke of the present invention.
Figure 2:
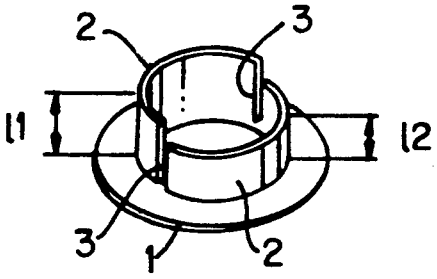
FIG. 2 is a perspective view of the present invention.

Numerals in the drawings indicate as follows:

Numeral 1 indicating a flange,

2 a tube member

3 slots

4 a cylinder member.

DETAILED DESCRIPTION OF THE INVENTION

Referring to the drawings, the invention shall be described in detail.

The choke includes a flange 1 and a tube member 2 on the top of the flange 1. The tube 2 is provided with slots 3 in its side wall to define walls in different heights (11) and (12) on each of the sides of the slots 3. The tube walls of different heights (11) and (12) respectively on each side of the slots 3 are arranged to have two different resonant points and thus suppress frequencies in two different band zones.

Figure 5:
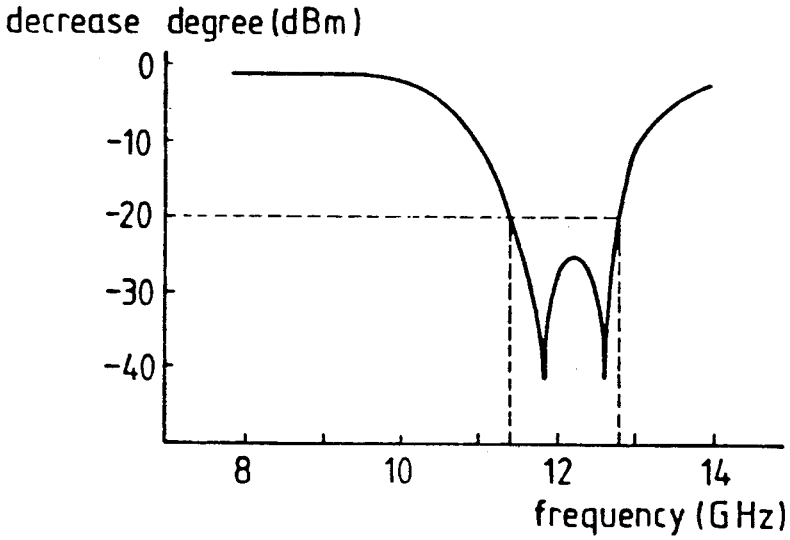
FIG. 5 and FIG. 6 respectively show graphs indicating the degree of attenuation of higher harmonics according to the construction of the invention.
Figure 9:
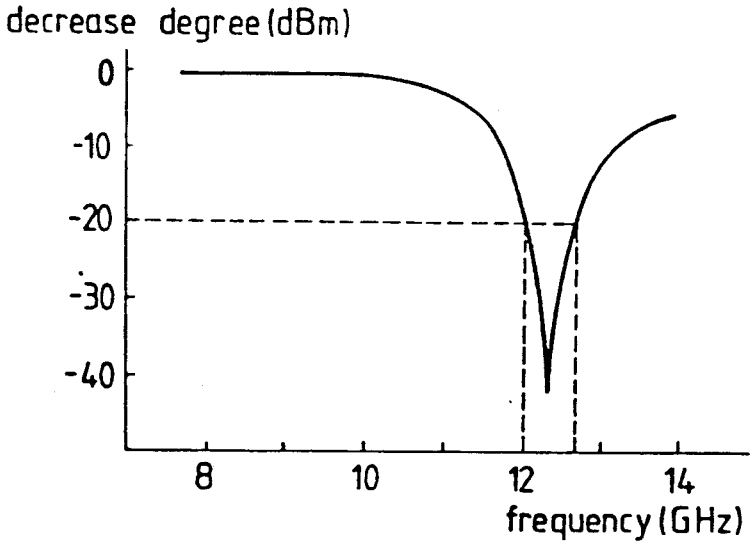
FIG. 9 (PRIOR ART)
FIG. 9 shows a graph indicating the degree of attenuation of a harmonic according to the conventional art.

The width of the frequency is attenuated with the choke of the invention as in the graph of FIG. 5. With the choke of a conventional art, however, the width of the frequency is attenuated as shown in the graph of FIG. 9 to indicate the narrowness of the attenuated frequency width compared with the width in FIG. 5.

Figure 3:
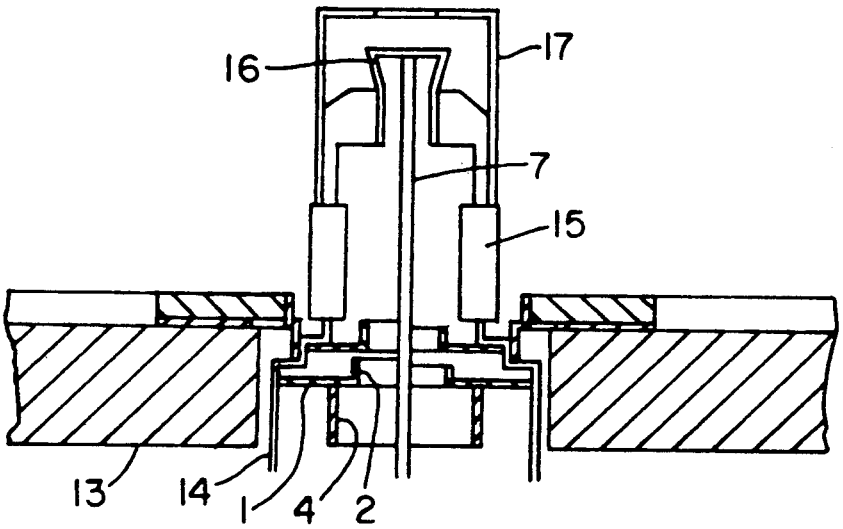
FIG. 3 and FIG. 4 show another embodiment of the invention with a partial section of its magnetron and a perspective view of its choke respectively.
Figure 4:
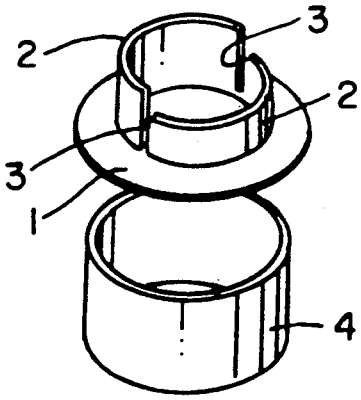
Figure 6:
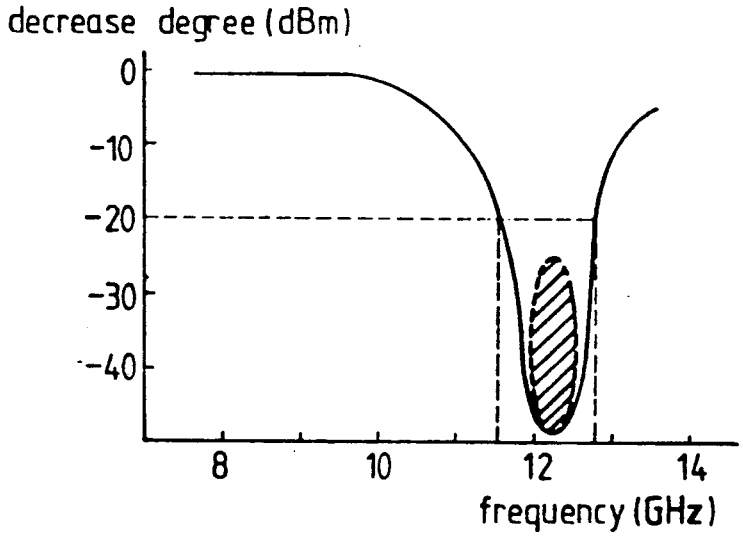
Figure 7:
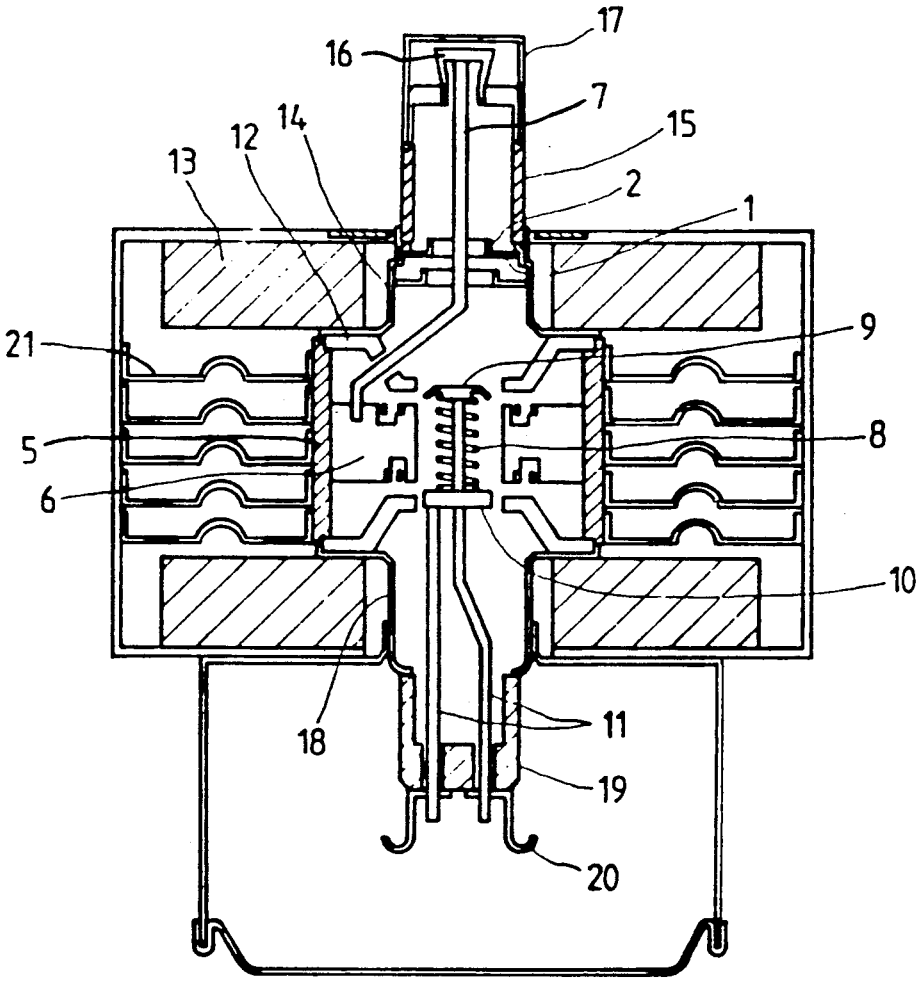
FIG. 7 (PRIOR ART)
FIG. 7 shows a sectional view of a magnetron equiped with a choke of the conventional art.
Figure 8:
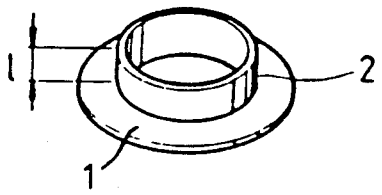
FIG. 8 (PRIOR ART)
FIG. 8 shows a perspective view of a conventional choke.

FIGS. 3 and 4 show another embodiment of the present invention, in that in addition to the flange 1, the tube 2 having walls of different heights (11) and (12) and the slots 3 there is provided another tube member 4 on the bottom side of the flange 1. The choke of the embodiment shows a larger attenuation in degree between two different frequency bands as shown in the graph of FIG. 6 by the slash part. The larger attenuation is caused by the increase of the harmonic suppression due to the tube member 4 on the bottom of the flange 1.

What is claimed is:

1. A magnetron choke for a microwave oven comprising a flange and a generally tubular member extending from the flange, the generally tubular member being characterized by first and second longitudinally extending slots dividing the tubular member into two opposed walls, the two walls extending different respective distances from the flange for suppressing frequencies in two different band zones.

2. A choke as in claim 1, wherein the generally tubular member is substantially cylindrical and wherein the two walls of the tubular member are substantially semi-cylindrical.

3. A choke as in claim 1, wherein the flange and the generally tubular members are of integral construction.

4. A choke as in claim 1, wherein the flange includes opposed first and second sides, the tubular member defining a first tubular member and extending from the first side of the flange, the choke further comprising a second tubular member extending from the second side of the flange for suppressing frequencies in at least one additional band zone.

5. A magnetron choke for a microwave oven comprising a generally annular flange having opposed first and second sides, first and second opposed substantially semi-cylindrical walls extending to different heights from the first side of the flange for suppressing frequencies in two different band zones.

6. A magnetron choke as in claims 5 further comprising a tubular wall extending from the second side of the flange for suppressing frequencies in at least one additional band zone.

7. A magnetron choke as in claim 5, wherein the first and second opposed substantially semi-cylindrical walls and the annular flange are of integral construction.

8. A magnetron choke assembly for a magnetron of a microwave oven, the magnetron comprising a generally cylindrical metal seal, said choke assembly including a plurality of chokes disposed in axially spaced relationship within the cylindrical metal seal, each said choke being of integral metal construction and comprising a flange mounted to the seal and a pair of opposed coaxially generated generally semi-cylindrical walls extending from the flange, the semi-cylindrical walls of the choke assembly defining different respective lengths for suppressing frequencies in different band zones.

* * * * *